US005251580A

United States Patent [19]

Torigai

[11] Patent Number: 5,251,580

[45] Date of Patent: Oct. 12, 1993

[54] CRANK CHAMBER PRECOMPRESSION TYPE TWO-CYCLE INTERNAL COMBUSTION ENGINE

[75] Inventor: Katsumi Torigai, Hamamatsu, Japan

[73] Assignee: Sanshin Kogyo Kabushiki Kaisha, Hamamatsu, Japan

[21] Appl. No.: 872,184

[22] Filed: Apr. 22, 1992

[30] Foreign Application Priority Data

Apr. 30, 1991 [JP] Japan ..... 3-126735

[51] Int. Cl.[5] ..... F02B 75/40

[52] U.S. Cl. ..... 123/65 P; 123/65 PD; 123/73 PP

[58] Field of Search ..... 123/65 P, 65 PE, 65 R, 123/73 PP, 65 W, 65 A, 65 PD

[56] References Cited

U.S. PATENT DOCUMENTS 2,169,652 8/1939 Ljungstrom ..... 123/65 PE
4,638,770 1/1987 Fox ..... 123/65 PE
4,821,687 4/1989 Iwai ..... 123/65 P
5,134,976 8/1992 Towner et al. ..... 123/65 P

FOREIGN PATENT DOCUMENTS 0102515 6/1982 Japan ..... 123/65 P
0022061 2/1985 Japan ..... 123/73 PP
62-32346 7/1987 Japan .
0266120 11/1988 Japan ..... 123/65 PE
2189839 11/1987 United Kingdom ..... 123/65 PE

*Primary Examiner*—David A. Okonsky
*Attorney, Agent, or Firm*—Ernest A. Beutler

[57] ABSTRACT

A number of embodiments of scavenging port configurations for two-cycle internal combustion engines wherein the a scavenge port is formed adjacent the exhaust port and is masked by a cylinder liner so as to avoid the escape of scavenging gases to the exhaust port, particularly at the end of the scavenging cycle.

3 Claims, 7 Drawing Sheets

CRANK CHAMBER PRECOMPRESSION TYPE TWO-CYCLE INTERNAL COMBUSTION ENGINE

BACKGROUND OF THE INVENTION

This invention relates to a crankcase chamber precompression type of two-cycle internal combustion engine and more particularly to an improved scavenging port arrangement for such engines.

As is well known, two-cycle engines have considerable desirability, primarily due to their compact and uncomplicated structure. In addition, the fact that each cylinder fires on each revolution permits a greater power output to be obtained with a two-cycle engine of a given displacement than a four-cycle engine of the same displacement. However, the use of porting in order to admit and discharge the gases to the combustion chambers of the engine have some disadvantages. For example, it is necessary to ensure a full charge of fresh gases and fuel for each combustion cycle. However, at the same time, it is also necessary to ensure that substantially all of the burned exhaust gases from the previous cycle are discharged when the fresh charge is introduced.

In order to provide complete charging and scavenging, it has been the practice to employ multiple scavenge and/or exhaust ports. Frequently, the use of such multiple ports positions adjacent scavenge and exhaust ports in close proximity to each other. When this occurs, there is a risk that some of the fresh scavenge charge entering the cylinder through the scavenge ports adjacent the exhaust ports may flow directly out of the exhaust port with loss of fuel efficiency and scavenging efficiency. It has, therefore, been proposed to provide some form of masking for the side edges of the scavenge ports that are adjacent the exhaust ports to preclude such escape of the scavenge charge.

One way in which the side edges of the scavenge ports have been masked is through the use of a cylinder liner and cylinder block in which the liner ports do not completely mate with the cylinder block passage openings. In fact, it has been the practice to provide a somewhat larger opening in the liner than in the cylinder block so as to ensure that manufacturing errors do not cause undesired masking of the various ports.

The aforenoted concept has been employed so as to provide some masking of the side edges of the scavenge ports adjacent the exhaust port. That is, the side edge of the scavenge port can be masked by having the port in the cylinder liner displaced relative to the port opening in the cylinder block so that the side of the scavenge passage is masked by the offset of the cylinder liner edge from the cylinder block edge which define the respective openings.

Although the aforenoted construction is very advantageous in avoiding loss of scavenge charge out of the exhaust port, there still is a problem with escape of scavenge charge from the exhaust port. Specifically, as the piston moves upwardly toward its top dead center position, the scavenge charge may flow from the upper portion of the scavenge port adjacent the exhaust port around and exit from the exhaust port. This is likely because at the end of the scavenge stroke the scavenge gases are entering the cylinder at a relatively low velocity and can easily escape through the adjacent exhaust port. The aforenoted masking does not completely solve this problem.

It is, therefore, a principal object of this invention to provide an improved scavenging port arrangement for a two-cycle engine.

It is a further object of this invention to provide an improved arrangement for the scavenging port of an internal combustion engine to ensure that no scavenge charge flows out of an adjacent exhaust port even if the scavenge and exhaust ports are disposed closely adjacent to each other.

SUMMARY OF THE INVENTION

This invention is adapted to be embodied in a porting arrangement for a two-cycle internal combustion engine that comprises a cylinder and a piston reciprocating in the cylinder. An exhaust port opens through the cylinder and is opened and closed by the piston for discharging exhaust gases from the cylinder. A scavenge port also opens through the cylinder and has a side edge that is adjacent a side edge of the exhaust port. The scavenge port is also opened and closed by the reciprocation of the piston for admitting a scavenge charge to the cylinder. The scavenge port is defined by a top edge which intersects the side edge. In accordance with the invention, the top edge is configured to close the portion of the scavenge port adjacent the exhaust port before the remainder of the scavenge port is closed for precluding the escape of scavenge charge through the exhaust port.

DETAILED DESCRIPTION OF THE PREFERRED EMBODIMENTS OF THE INVENTION

Figure 1:
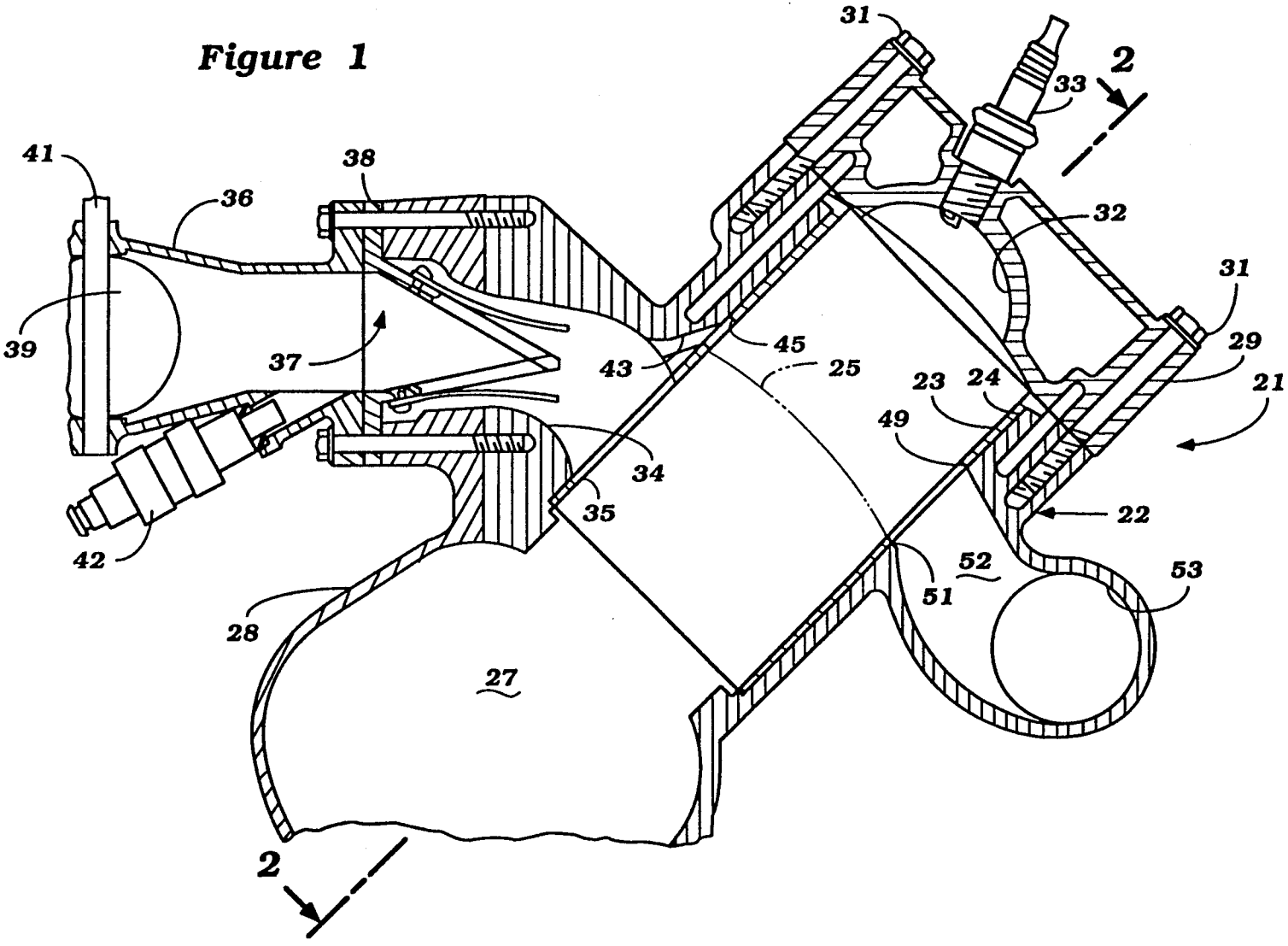
FIG. 1 is a cross-sectional view taken through a single cylinder of a multiple cylinder internal combustion engine constructed in accordance with an embodiment of the invention.
Figure 2:
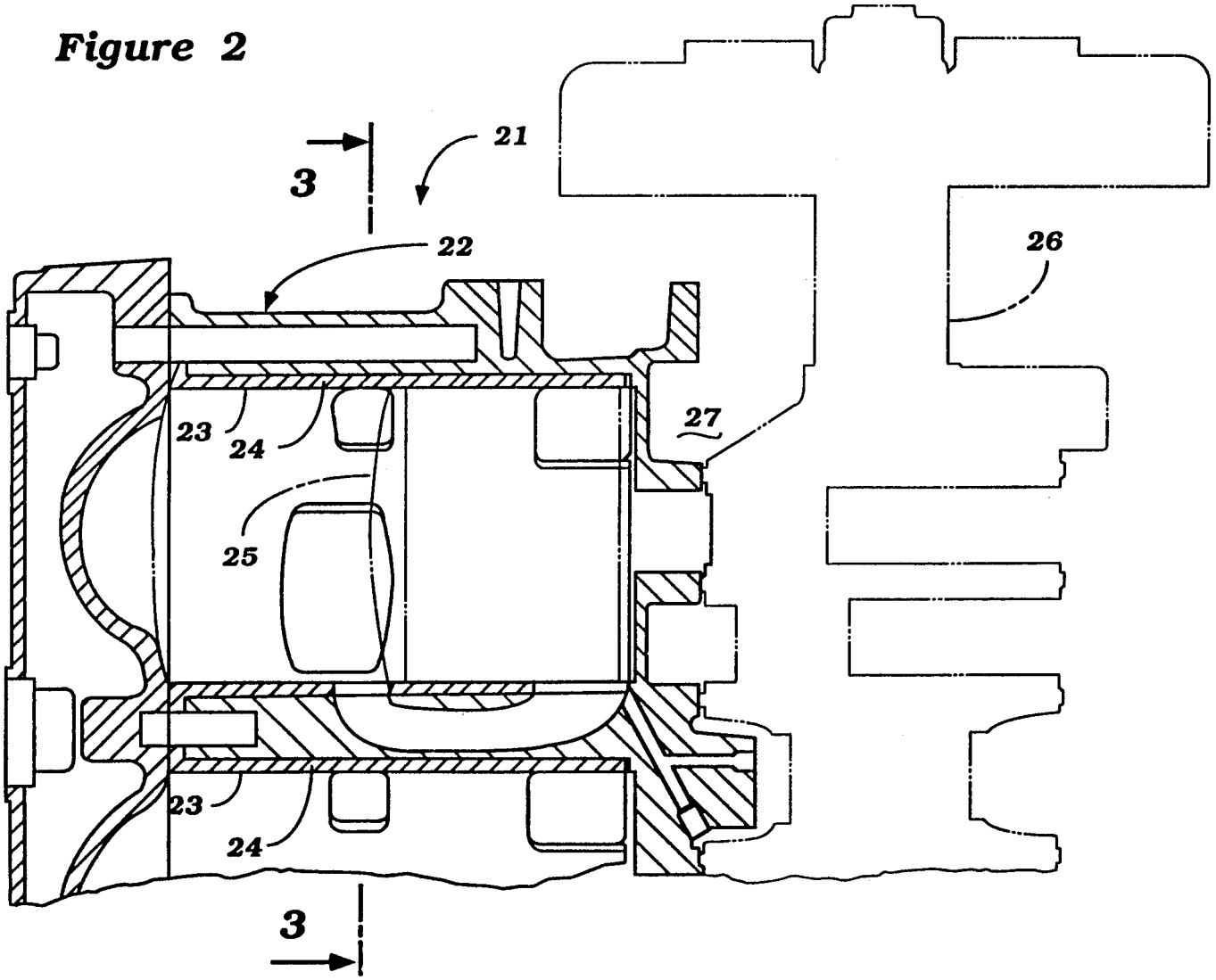
FIG. 2 is a cross-sectional view taken along the line 2—2 of FIG. 1.

Referring first in detail to the embodiment of FIGS. 1-8, and initially primarily to FIGS. 1 and 2, a two-cycle crankcase compression internal combustion engine constructed in accordance with this embodiment is indicated generally by the reference numeral 21. Since the invention relates primarily to the porting system for the engine 21, some details of the engine construction, which may be considered to be conventional, are not illustrated and will not be described.

The engine 21 includes a cylinder block assembly, indicated generally by the reference numeral 22 and which is formed from a casting of a lightweight material such as aluminum or aluminum alloy. The cylinder block 22 is formed with three aligned cylinder bores 23 which are formed by pressed or cast-in liners 24 contained within the cylinder block 22. Although the invention is described in conjunction with a three cylinder in-line engine, it should be readily apparent to those skilled in the art that the invention can be practiced in conjunction with engines having other cylinder numbers and other cylinder configurations.

Pistons, shown in phantom in FIGS. 1 and 2 and identified by the reference numeral 25, reciprocate in each of the cylinder bores 23. The pistons 25 are connected by means of connecting rods (not shown) to a crankshaft, shown in phantom only in FIG. 2 and identified by the reference numeral 26, that rotates in a crankcase chamber 27. The crankcase chamber 27 is formed by the cylinder block 22 and a crankcase member 28 that is affixed to the cylinder block 22 in any known manner. As is typical with two-cycle crankcase compression internal combustion engines, the crankcase chambers 27 associated with each of the cylinder bores 23 are sealed from each other in any suitable manner.

A cylinder head assembly 29 is affixed to the cylinder block 22, as by threaded fasteners 31. The cylinder head assembly 29 is provided with individual recesses 32 each of which cooperates with a respective cylinder bore 23 to provide a variable volume chamber, sometimes referred to as the combustion chamber. The cylinder head recesses 32 are offset to one side of the cylinder bore 23, this offset being toward the scavenge side of the engine, to provide a loop type of scavenging, as will become readily apparent.

Spark plugs 33 are mounted in the cylinder head 29 in an appropriate manner and have their spark gaps extending into the cylinder head recesses 32. The spark plugs 33 are fired by a suitable ignition system.

A fuel/air charge is delivered to the individual crankcase chambers 27 associated with each cylinder bore 23 by an induction system that includes an intake passage 34 which is formed in the scavenge side of the cylinder block 22 and which communicates with the crankcase chambers 27 through intake port openings 35 formed in the lower portion of the cylinder liners 24. The pistons 25 may be provided with respective cutouts that also permit the flow from the intake passages 34 to the crankcase chambers 27. An intake manifold 36 is affixed to the cylinder block 22 with a reed-type check valve, indicated generally by the reference numeral 37 and having a caging number 38 being interposed between the intake manifold 38 and the cylinder block 22. As is well known, the reed-type check valve 37 permits an air charge to enter the crankcase chambers 27 but will preclude reverse flow.

A throttle valve 39 is positioned in the intake manifold 36 upstream of the reed-type check valves 37 and the throttle valves 39 associated with each cylinder bore 23 are affixed to respective throttle valve shafts 41 that are interconnected for simultaneous operation by a remotely positioned accelerator pedal or throttle control.

In the illustrated embodiment, the engine 21 is of the fuel injected type and to this end there is provided a fuel injector 42 mounted in the intake manifold 36 for each cylinder of the engine. The fuel injectors 42 are electronically controlled and will provide a supply of fuel for each cylinder under a suitable control mechanism, which may be of any type well known in the art.

The charge which has been admitted to the crankcase chamber 27 during the upward movement of the pistons 25 through the intake passages 34 is compressed as the pistons 25 move downwardly. This compressed charge is then transferred to the cylinder bore 23 and combustion chamber above the piston 25 through a pair of Siamese center scavenge passages 43 formed in the cylinder block 22 and which communicate partially with the intake passage 34 so as to improve volumetric efficiency. The scavenge passageways 43 have port openings 44 formed in the cylinder block 22 adjacent the cylinder liner 24. These port openings 44 cooperate with scavenge ports 45 formed in the cylinder liner 23 and have a relationship as will be later described.

There are also provided a pair of side scavenge passages 46 formed in the cylinder block 22 and which extend from the crankcase chambers 27 to scavenge port openings 47 formed in the cylinder block 22. These scavenge port openings 47 cooperate with scavenge ports 48 also formed in the cylinder liner 24 and having a relationship as will be later described.

Basically, the scavenge ports 45 and 48 and associated passages 43 and 46 are configured so as to direct the intake scavenge charge upwardly toward the cylinder head recess 32 and then turn downwardly. An exhaust port 49 is formed in each cylinder liner 24 in general opposing relationship to the center scavenge ports 45 and cooperates with exhaust port openings 51 formed in the cylinder block 22 at the cylinder end of exhaust passages 52 formed in the cylinder block 22. The exhaust passages 52 all merge to a common manifold section 53 also formed in the cylinder block 22 through which the exhaust gases are discharged to the atmosphere through a suitable exhaust system (not shown).

Figure 3:
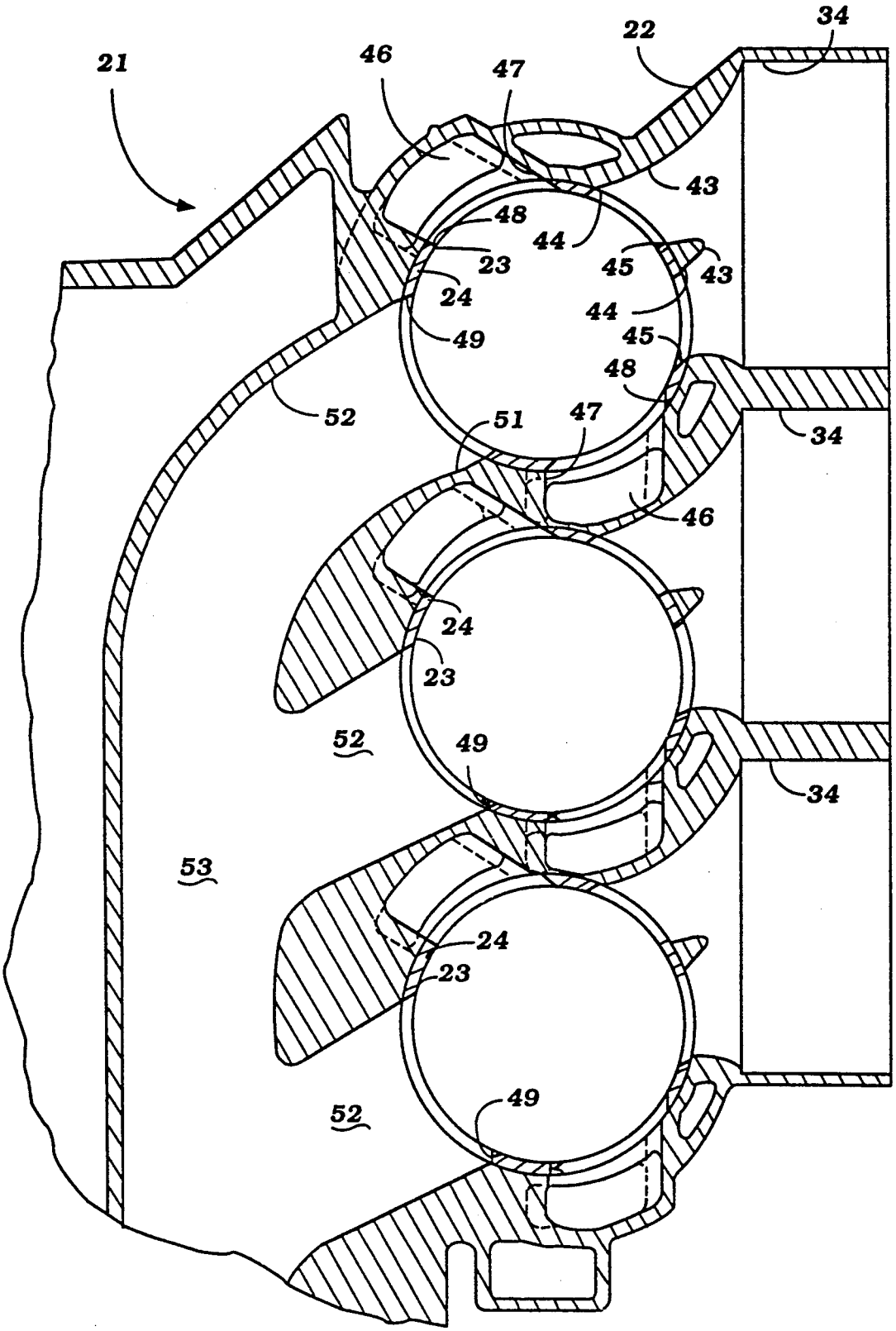
FIG. 3 is a cross-sectional view taken along the 3—3 of FIG. 2.

As may be best seen in FIG. 3, the side scavenge passages 46 are somewhat inclined from their lower crankcase ends to their upper cylinder bore ends so that the scavenge charge will be directed generally upwardly and also back toward the charge issuing from the center scavenge ports 45. However, because the side scavenge ports 48 are disposed closely adjacent the exhaust ports 49, there is a risk that some of the scavenge air flow will pass directly out of the exhaust ports 49 rather than achieving the desired scavenging action. This problem is particularly aggravated at the point when the pistons 25 are moving upwardly to complete the closure of the respective scavenge ports 45 and 48. At that time, the scavenging air flow will have a relatively low velocity and the likelihood of exit through the exhaust port 49 is greatly increased. As has been previously noted, the positioning of the cylinder liner scavenge ports 45 and 48 relative to the cylinder block scavenge port openings 44 and 47 is configured so as to reduce the likelihood of this effect and this result may be best understood by reference to FIGS. 4–8.

Figure 4:
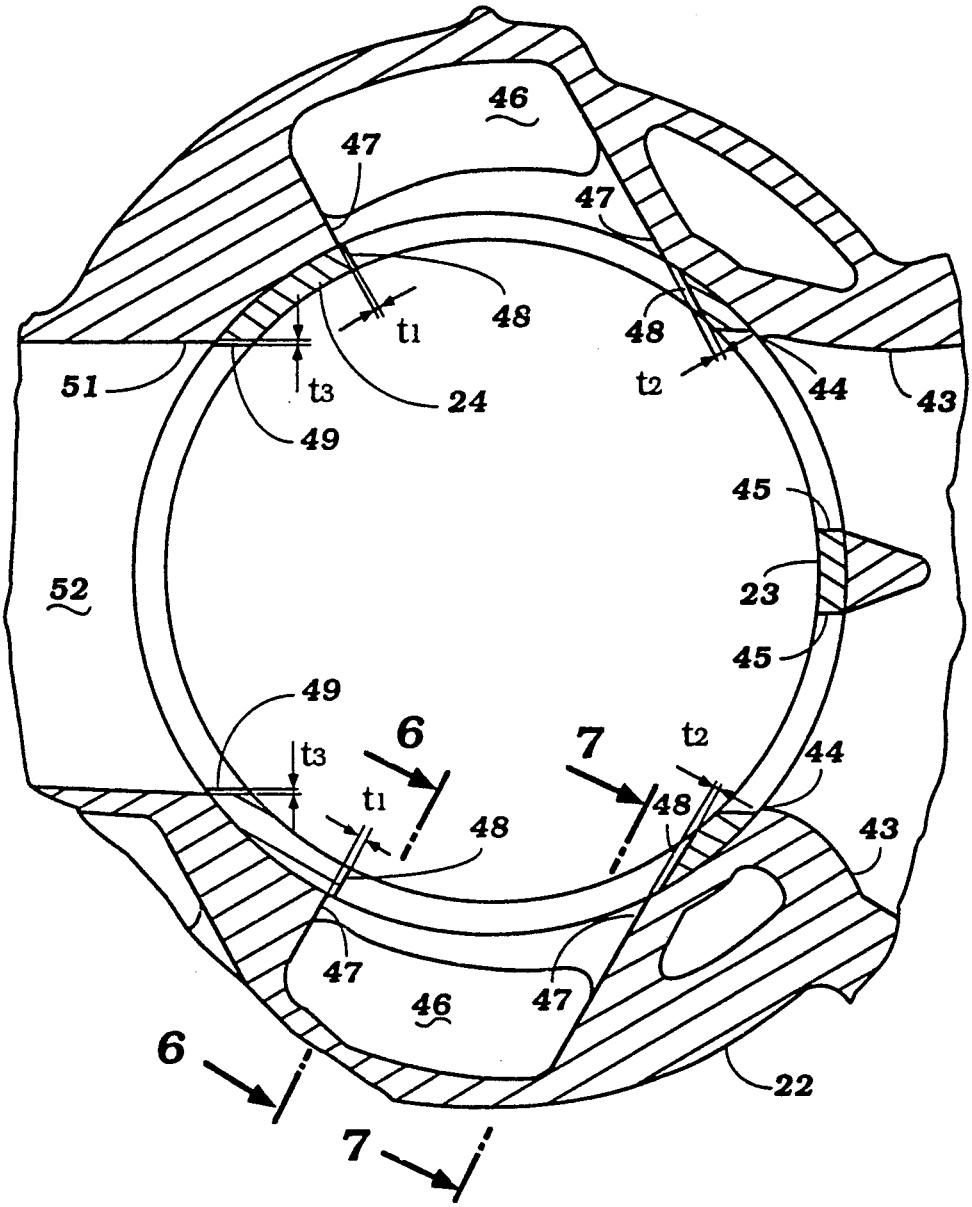
FIG. 4 is a further enlarged view taken through one of the cylinders along the same plane as FIG. 4 and shows the port configuration.
Figure 5:
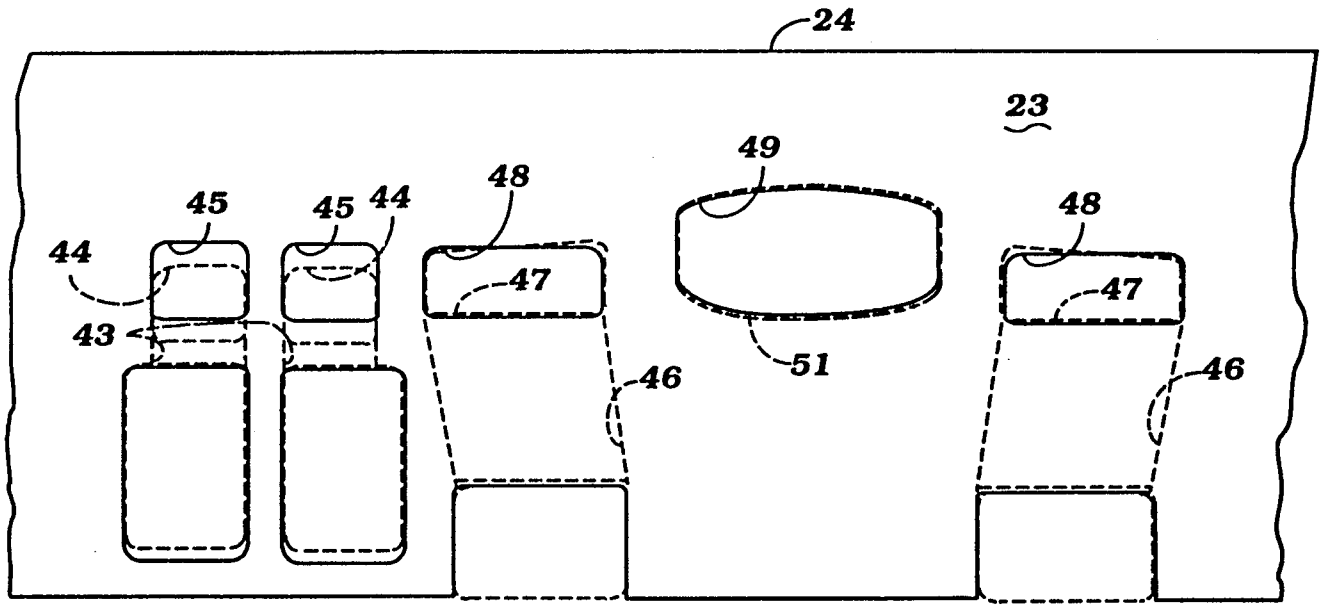
FIG. 5 is a developed view showing the port configuration.

As may be best seen in FIGS. 4 and 5, the intake ports 45 of the cylinder liner 24 are sized so as to be slightly larger in width in a circumferential direction than the port openings 44 of the cylinder block center scavenge passages 43 to accommodate manufacturing tolerances. Also, as may be seen in FIG. 5, the upper edge of the port openings 45 is somewhat higher than the port openings 44 of the cylinder block so as to provide some masking in the time at which the scavenge ports are closed.

With respect to the side scavenge ports 48 and the exhaust port 49, an arrangement is provided for ensuring masking of these ports, particularly at adjacent sides so as to avoid the loss of scavenging flow out of the exhaust port 49. In addition and as will be described, the height or upper edge of the ports relative to the cylinder block port openings 47 is staggered for the same purpose.

It will be noted that the side edges of the exhaust port 49 of the liner 24 are smaller in circumferential length than the port openings 51 of the cylinder block. As a result, the exhaust gases must flow around this edge to exit the cylinder and this will tend to reduce the escape of scavenge air from the scavenge ports 48 to the exhaust port 49. In addition, the side edges of the scavenge ports 48 of the cylinder liner 24 are spaced at a distance $t_1$ inwardly from the scavenge port openings 47 of the cylinder block so as to mask the side edges of the port openings 48 and direct the scavenge flow away from the exhaust ports 49.

At the opposite side edges of the scavenge ports 48, the liner openings are offset by a distance $t_2$ relative to the port openings 47 of the cylinder block so that the flow will be directed more toward the center scavenge ports 45 and away from the exhaust ports 49. The offsets $t_2$ are greater than the offsets $t_1$ so that the scavenge ports 48 are greater in width than the cylinder block port openings 47 so as to accommodate manufacturing variations.

As to the exhaust port 49, it is offset by a distance $t_3$ on both sides relative to the cylinder block exhaust port opening 51 so as to further provide a masking effect that will ensure against scavenge gases from easily flowing through the exhaust port 49 without substantially restricting the flow of exhaust gases from the cylinder bore 23.

Figure 7:
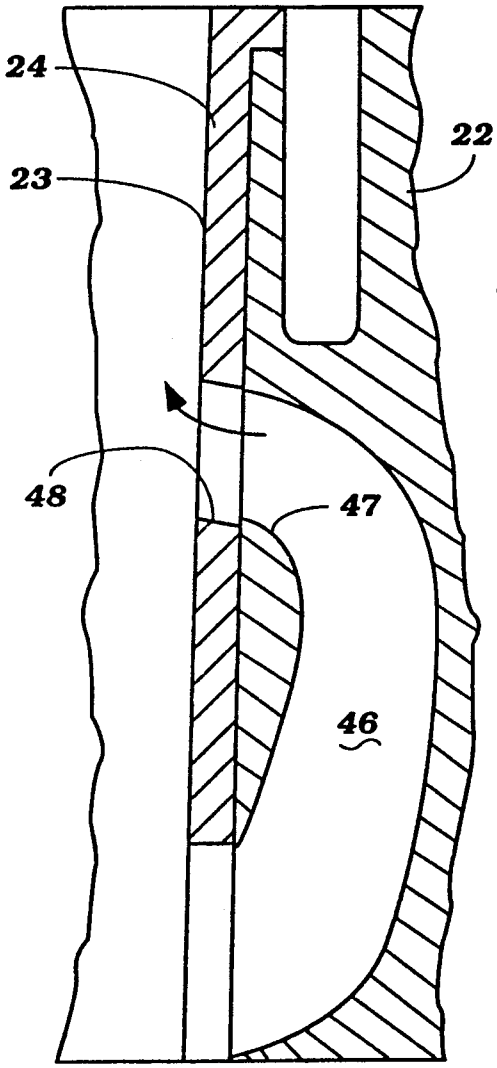
FIG. 7 is a cross-sectional view taken along the line 7—7 of FIG. 4.
Figure 6:
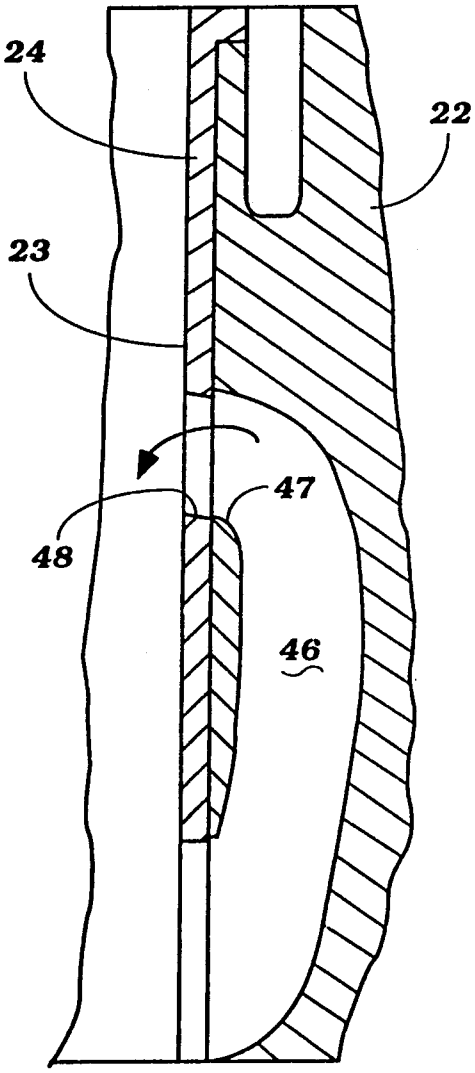
FIG. 6 is a cross-sectional view taken along the line 6—6 of FIG. 4.
Figure 8:
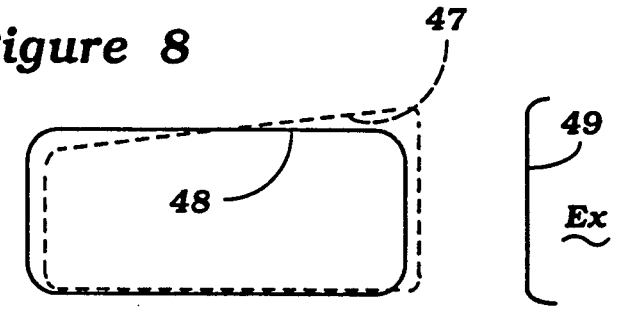
FIG. 8 is a further enlarged developed view of the side scavenge port.

As may be best seen in FIGS. 5 and 8, the upper edges of the cylinder block scavenge port openings 47 are somewhat tapered in an upward direction and hence would tend to close after the other side as the piston moves upwardly. Hence, scavenge gases could flow out of the exhaust port 49 due to this delayed opening and the fact that the scavenge air flow is at a relatively low velocity at that time. To avoid this, the cylinder liner scavenge ports 48 are in inclined downwardly relative to the upper edges of the cylinder block scavenge port openings 47 so as to provide some masking and to avoid the flow of scavenge gases out of the scavenge ports 48 into the exhaust port 49. This effect is also shown in FIGS. 6 and 7.

Therefore, as a result of the aforedescribed construction it will be ensured that good scavenging is accomplished while at the same time redirecting the peripheral scavenge flow adjacent the exhaust port 49 away from the exhaust port, particularly as the scavenge ports 48 become closed, so as to ensure good scavenging while at the same time avoiding the passage of the fresh fuel/air charge out of the exhaust port 49.

Figure 9:
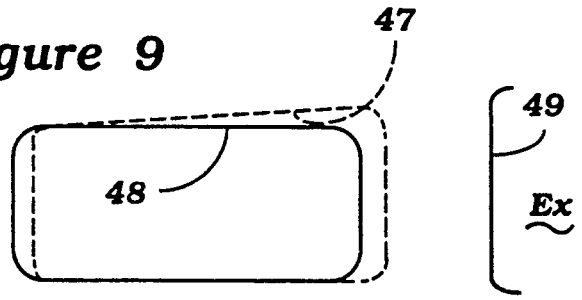
FIG. 9 is a view, in part similar to FIG. 8, showing another embodiment of the invention.
Figure 10:
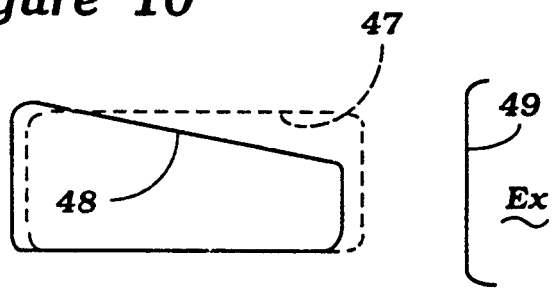
FIG. 10 is a developed view, in part similar to FIGS. and 9, and shows yet another embodiment of the invention.
Figure 11:
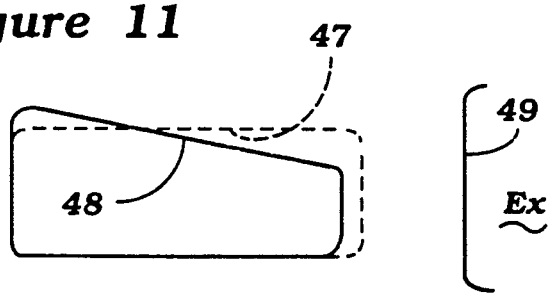
FIG. 11 is a developed view, in part similar to FIGS. 8-10, and shows a still further embodiment of the invention.

FIGS. 9, 10 and 11 show additional ways in which the upper edge of the scavenge port openings 48 may be masked relative to the cylinder block scavenge port openings 47 so as to accomplish the aforenoted results. Of course, various other arrangements can be employed to achieve this end.

It should be readily apparent from the foregoing description that the described construction ensures good scavenging within the cylinder without the loss of fresh fuel/air charge out of the exhaust port, even though the scavenge ports may be closely adjacent the exhaust port. Of course, the foregoing description is that of preferred embodiments of the invention and various changes and modifications may be made without departing from the spirit and scope of the invention, as defined by the appended claims.

I claim:

1. A porting arrangement for a two-cycle internal combustion engine comprising a cylinder block, a cylinder liner having a cylinder bore supported within said cylinder block, a piston reciprocating in said cylinder bore, an exhaust port opening through said cylinder liner and opened and closed by said piston for discharge of exhaust gases from said cylinder bore, a scavenging port opening through said cylinder bore and having a side edge adjacent a side edge of said exhaust port, said scavenging port being opened and closed by the reciprocation of said piston for admitting a charge to said cylinder, a scavenge passage formed in said cylinder block and terminating in a scavenge passage opening formed adjacent said cylinder liner and said scavenge port, said scavenging port being defined in part by a top edge intersecting said side edge, said top edge being configured to mask only the portion of said scavenging passage opening adjacent said exhaust port for precluding the flow of scavenging gases directly from said scavenging port to said exhaust port.

2. A porting arrangement for a two-cycle engine as set forth in claim 1 wherein the masking is accomplished by having the upper edge of the scavenge port disposed at an angle relative to the upper edge of the scavenge passage opening in the cylinder block.

3. A porting arrangement for a two-cycle engine as set forth in claim 2 wherein the side of the scavenge port adjacent the exhaust port further masks the corresponding side of the scavenge passage opening.

* * * * *